US005376168A

United States Patent [19]

Inculet

[11] Patent Number: 5,376,168

[45] **Date of Patent: * Dec. 27, 1994**

[54] ELECTROSTATIC PARTICLE FILTRATION

[75] Inventor: Ion I. Inculet, London, Canada

[73] Assignee: The L. D. Kichler Co., Cleveland, Ohio

[ * ] Notice: The portion of the term of this patent subsequent to Sep. 1, 2009 has been disclaimed.

[21] Appl. No.: 909,082

[22] Filed: Jun. 5, 1992

Related U.S. Application Data

[63] Continuation-in-part of Ser. No. 481,854, Feb. 20, 1990, Pat. No. 5,143,524.

[51] Int. Cl.[5] ..... B03C 3/14; B03C 3/70

[52] U.S. Cl. ..... 96/54; 15/1.51; 15/339; 96/59; 96/66; 96/68; 96/80; 96/88; 323/903; 361/226; 361/233

[58] Field of Search ..... 55/2, 123, 131, 139, 55/154, 155, 124, 126, 6; 15/1.51, 4, 320, 339; 361/226, 233; 323/903; 95/63; 96/17, 54, 66, 68, 55, 57, 58, 80, 98–100, 59, 88

[56] References Cited

U.S. PATENT DOCUMENTS

| | | | |
|---|---|---|---|
| 1,059,253 | 4/1913 | Wimbish | 55/151 |
| 2,080,242 | 5/1937 | Ward | 55/131 |
| 3,334,370 | 8/1967 | Boyd | 15/326.2 |
| 3,355,562 | 11/1967 | Boyd | 200/86.5 |
| 3,590,412 | 7/1971 | Gerbasi | 118/637 |
| 3,592,639 | 7/1971 | Chaplinski | 134/1 |
| 3,597,789 | 8/1971 | Boyd | 15/383 |
| 3,724,174 | 4/1973 | Walkenhorst | 55/123 |
| 3,739,552 | 6/1973 | Webster et al. | 55/123 |
| 3,930,815 | 1/1976 | Masuda | 55/131 |
| 4,058,936 | 11/1977 | Marton | 51/170 T |
| 4,155,727 | 5/1979 | Kaulig | 55/381 |
| 4,185,972 | 1/1980 | Nitta et al. | 55/155 |
| 4,198,061 | 4/1980 | Dunn | 15/1.51 |
| 4,213,224 | 7/1980 | Miller | 15/344 |
| 4,225,086 | 9/1980 | Sandell | 239/428 |
| 4,282,626 | 8/1981 | Schneider | 15/320 |
| 4,376,642 | 3/1983 | Verity | 55/105 |
| 4,588,537 | 5/1986 | Klaase et al. | 264/22 |
| 4,626,263 | 12/1986 | Inoue et al. | 55/155 |
| 4,652,282 | 3/1987 | Ohmori et al. | 55/155 |
| 4,662,903 | 5/1987 | Yanagawa | 96/59 |
| 4,665,581 | 5/1987 | Oberdorfer | 15/326 |
| 4,697,300 | 10/1987 | Warlop | 15/339 X |
| 4,702,752 | 10/1987 | Yanagawa | 96/68 |
| 4,715,078 | 12/1987 | Howard et al. | 15/4 |
| 4,715,085 | 12/1987 | Johanson | 15/339 |
| 4,715,086 | 12/1987 | Johanson et al. | 15/339 |
| 4,785,492 | 11/1988 | Gilime | 15/380 |
| 4,980,796 | 12/1990 | Huggins et al. | 55/123 |

FOREIGN PATENT DOCUMENTS

| | | |
|---|---|---|
| 821900 | 9/1969 | Canada . |
| 207203 | 1/1987 | European Pat. Off. . |
| 0332282 | 9/1989 | European Pat. Off. . |

(List continued on next page.)

OTHER PUBLICATIONS

European patent appln. No. 87103225.6 filed Mar. 6, 1987.

*Primary Examiner*—Richard L. Chiesa

*Attorney, Agent, or Firm*—Watts, Hoffmann, Fisher & Heinke

[57] ABSTRACT

An on board electrostatic filter for a vacuum cleaner is disclosed. The filter includes a pair of conductive filaments insulated from one another and located close together in a substantially parallel, side-by-side relationship. Circuitry is provided for applying an electrical potential difference between the two conductors. This dual filament conductor is preferably packed into a relatively small volume in a tortuous configuration, to form a random mesh, or can be oriented in a more regular serpentine configuration. Other embodiments describe the mesh electrostatic filter to purify air in an HVAC system.

26 Claims, 5 Drawing Sheets

FOREIGN PATENT DOCUMENTS

| | | |
|---|---|---|
| 0345828 | 12/1989 | European Pat. Off. . |
| 443254 | 8/1991 | European Pat. Off. . |
| 2115827 | 7/1972 | France . |
| 894154 | 10/1953 | Germany . |
| 2166206 | 5/1973 | Germany . |
| 334210 | 3/1931 | United Kingdom . |
| 881975 | 11/1961 | United Kingdom . |
| 1025064 | 4/1966 | United Kingdom . |
| 1094832 | 12/1967 | United Kingdom . |
| 1154604 | 6/1969 | United Kingdom . |
| 1379738 | 1/1975 | United Kingdom . |
| 1501927 | 2/1978 | United Kingdom . |
| 1535635 | 12/1978 | United Kingdom . |
| 2029259 | 5/1980 | United Kingdom . |
| 2033248 | 5/1980 | United Kingdom . |
| 2108377 | 5/1983 | United Kingdom . |
| 2131320 | 6/1984 | United Kingdom . |
| 1212584 | 2/1986 | U.S.S.R. ..... 55/131 |

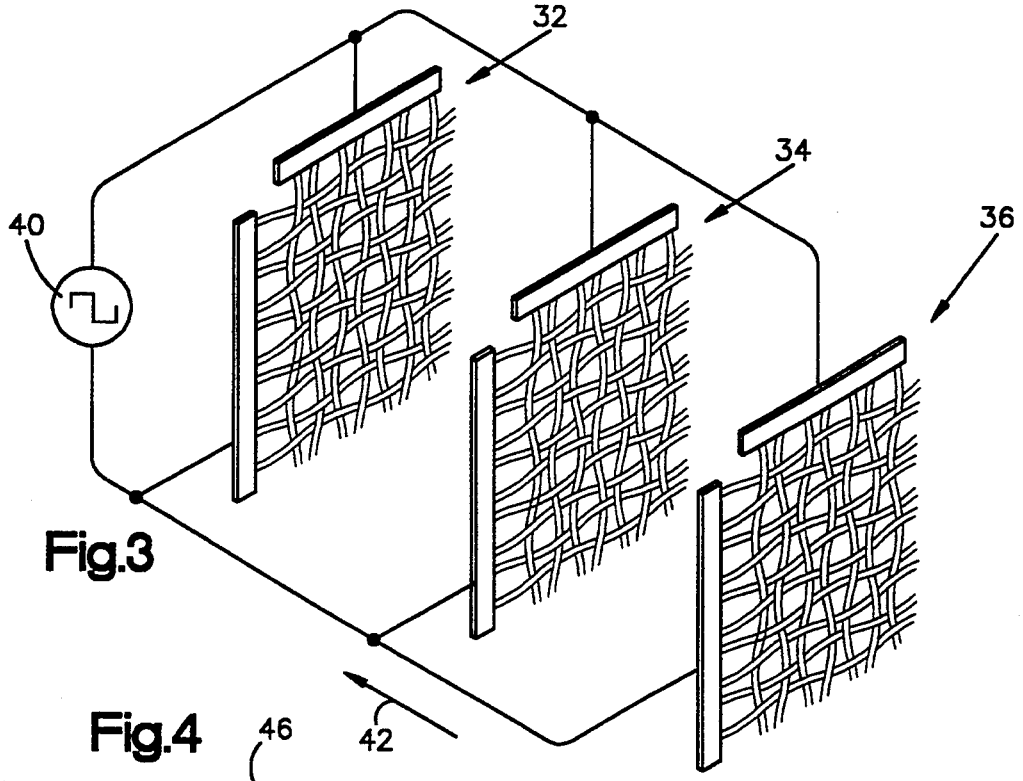
Fig.3
Fig.4
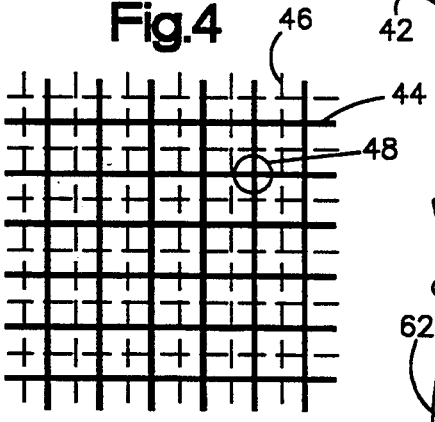
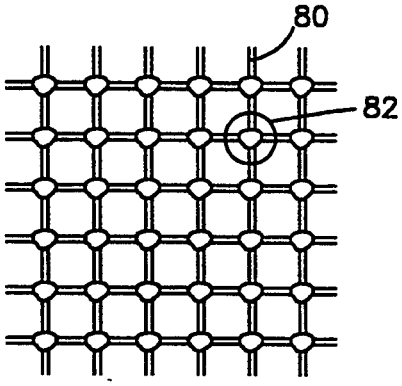
Fig.7
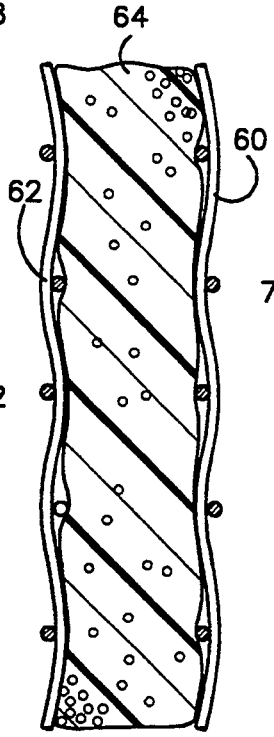
Fig.5
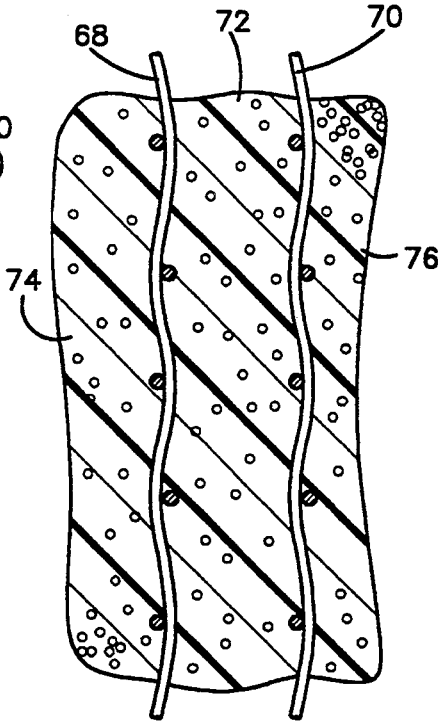
Fig.6

+9V TO −9V SWITCH
POTENTIOMETER TURNED FULLY CLOCKWISE

| SWITCH POSITION | TIME (SEC) |
|---|---|
| 1 | 1 |
| 2 | 2 |
| 3 | 4 |
| 4 | 8 |
| 5 | 16 |
| 6 | 32 |
| 7 | 64 |
| 8 | NOT USED |

POTENTIOMETER TURNED FULLY COUNTERCLOCKWISE

| SWITCH POSITION | TIME (SEC) |
|---|---|
| 1 | 7 |
| 2 | 14 |
| 3 | 28 |
| 4 | 56 |
| 5 | 112 |
| 6 | 224 |
| 7 | 448 |
| 8 | NOT USED |

ELECTROSTATIC PARTICLE FILTRATION

CROSS-REFERENCE TO RELATED APPLICATIONS

This is a continuation-in-part of U.S. application Ser. No. 07/481,854, filed Feb. 20, 1990. Now U.S. Pat. No. 5,143,524.

TECHNICAL FIELD

This invention relates generally and is applicable to most forms of electrostatic filtration, including HVAC applications. It relates more particularly to an on-board electrostatic filter for trapping minute particles picked up by a vacuum cleaner and propelled into its dirt collector.

BACKGROUND ART

An important application of the present invention is in vacuum cleaners, as well as, in HVAC and other applications. Such machines include apparatus for applying suction to dislodge undesirable particulate matter from a surface to be cleaned, by generating a high velocity air flow. The suction apparatus includes structure for channelling the dirt-laden air into a narrow stream. A collection bag or other receptacle is mounted to receive the particle and air flow. A typical bag includes a jacket formed of air pervious material, such as paper and/or tightly woven fabric, to mechanically filter particulate matter, while allowing the filtered air to dissipate outwardly through the bag and back into the external environment. Vacuum cleaners and other filter devices which rely solely on mechanical filtration, however, filter only particles of greater than a given size, while allowing smaller particles to pass through the filter and re-enter the external environment. This is because, in order to permit the air to pass freely out of the bag, the interstices in the paper or fabric, which permit air to pass through, cannot be too small. Otherwise, the suction air stream is inhibited, and air velocity becomes too low for good suction. While one could increase suction and air volume by use of more powerful electric motor drive systems, the use of inordinately large and heavy electric motors in a household appliance such a vacuum cleaner can become both impractical and uneconomical. The weight and cost of large motors make their use prohibitive in vacuum cleaners designed for household use.

The fine particles that pass through the bag and back into the external environment can include very small dust particles, contributing to odor and re-accumulation. Other particles escaping filtration are allergy-aggravating pollen and bacteria, as well as mites, which can be a health hazard.

One proposal to improve a vacuum cleaner's effectiveness in filtering very small particles has been to add on-board electrostatic filtration equipment, while still maintaining a reasonable pressure drop through the filter media and hence reducing the size and power of the suction motor system. Such equipment has included at least two elements between which an electrical potential difference is applied. The electrical potential difference generates an electric field between the elements. It also causes the elements to become electrically charged. The element to which voltage of a given polarity is applied attracts oppositely charged particles of dirt, as well as oppositely charged, naturally occurring ions, such as gas ions.

The elements are positioned in the particle-laden air stream. A charged element, as noted above, attracts oppositely charged particles passing along in the air stream. Moreover, even some neutrally charged particles are attracted to the element by a phenomenon known as dielectrophoresis.

It has also been proposed to augment such electrostatic filtration by provision of a so-called "corona" device in the air stream. A corona device produces an electrical space charge which is distributed generally throughout a region. Such space charge, if generated in the particle-laden air stream, pre-charges the particles. This imposition of charge on the particle increases the force attracting or repelling them to the electrically polarized filter element.

One problem with on-board vacuum cleaner electrostatic filters is the necessity for providing a relatively high electrical voltage on a substantially continuous basis while the machine is operating. This often requires large, heavy and expensive power supplies, sometimes including heavy batteries. Such equipment degrades portability and ease of machine operation.

A further proposal has been to place in the air stream a piece of electrically charged fleece.

Another type of device for electrostatic filtering incorporates what is known as "electret" material. Electret materials have low electrical conductivity and usually have dielectric properties as well. They also have the property of retaining charge polarization for a long time. Electret materials have been used as electrostatic filters in surgical masks.

The filter equipment described above has a further disadvantage. When a charged surface "loads up" with accumulated particles, the charge on the charged filter element can become neutralized or canceled, due to the opposite polarization of particles and ions attracted to its surfaces. This tends to cancel the generated electrical fields, hindering or totally disabling operation of the device.

An object of this invention is to provide electrostatic filtering apparatus and circuitry (1) whose effectiveness does not deteriorate as the amount of retained filtered material increases, (2) which is effective at low operating voltages, and (3) which is lightweight, relatively inexpensive and compact.

DISCLOSURE OF THE INVENTION

The disadvantages of the prior art are reduced or eliminated by the provision of a vacuum cleaner having a new and improved on-board electrostatic filtration system. The electrostatic filtration system includes a mesh finely woven of two sets of conductive filaments or fine wires which are electrically insulated one from another. A source of electrical potential is coupled to apply an electrical potential difference between the two sets of conductive filaments or wires. Circuitry is provided for repeatedly reversing the polarity of the electrical potential applied between the sets of conductive filaments or wires.

The mesh is located within the vacuum cleaner's dirt receptacle, which typically is a bag. The mesh has an expanse large enough to cover a substantial portion of the interior of the bag.

The reversal in polarity of the applied electrical potential difference assists in maintaining filtration effectiveness which would otherwise be degraded by the accumulation of a substantial layer of filtered particulate matter on the mesh, and by attraction to the mesh of oppositely charged neutrally occurring ions. When the voltage polarity is abruptly reversed, the resulting suddenly reversed charge polarity on the wire insulation surface adds directly to other charge already on the nearby particles and which is left over from the previous cycle. This restores, and actually increase, the strength of the electrical field produced by the electrical potential difference applied, to achieve better electrostatic filtering results.

In accordance with a more specific embodiment, the frequency of voltage polarity reversal is low, on the order of about one cycle per second or less. The low frequency allows for the desirable electrostatic phenomena to occur, while still providing for repeated polarity reversal to restore and magnify the filtering electric fields produced by the electrified mesh.

In accordance with a more specific embodiment, multiple stages of mesh are used. The stages are serially stacked in the air flow, and function together to filter the discharge air more thoroughly than a single mesh.

In accordance with other specific embodiments, high permitivity material is added to the meshes in order to increase the strength of the electric fields obtainable for a given voltage. The high permitivity material can be located between the meshes. Another location for high permitivity material is its local application between mesh wire intersections in a single mesh.

In accordance with another specific embodiment, a fibrous mechanical filter can be added in series with a mesh for enhanced filtration.

According to a specific feature, a suitable high permitivity material comprises aluminum oxide powder.

Another specific embodiment, applicable to a multistage construction, involves the staggered placement of successive meshes. Such staggered placement increases the density of charged wire distribution across the cross section of the air stream, without appreciably increasing resistance to the air flow.

Another embodiment of a highly effective electrostatic filter construction includes a long strand made up of dual filamentary conductors. The filamentary conductors are thin, and each is covered with electrical insulation which is a fluxible solid. Over substantial portions of the length of the insulated filamentary conductors, they are closely spaced, i.e., substantially adjacent one another. Circuitry is coupled between the dual filaments for applying an electrical potential difference therebetween.

The dual filamentary strand described in the preceding paragraph can be wound or packed into many configurations which render it an effective electrostatic filter. In one specific embodiment, the dual filament strand is bent into a winding configuration. More specifically, the strand can be wound into a configuration wherein it criss-crosses itself at many locations and in several layers. In another configuration, a long portion of such a strand, appropriately connected to its electrical circuitry, is packed randomly into what shall be called here a "volume mesh". In a volume mesh configuration, the bends in the strand are essentially random in nature, and the entire strand is packed into a mesh which provides many tortuous paths for a moving gas to pass through and be filtered therein.

In a more specific embodiment, the volume mesh of packed strand is packed into a structure which confines it generally to a predetermined volume. Such a structure can constitute, for example, a relatively thin box having perforated or screened ends to permit passage of a gas, such as air, to be filtered through the volume mesh.

In such a configuration, the volume mesh of packed dual filament strand has application to the heating, ventilating and air conditioning (HVAC) environment. A volume mesh filter such as described above can easily be incorporated into the ducting of a HVAC system, or it can even be installed at individual room outlets, such as heating and air conditioning registers.

One reason this configuration of electrostatic filter is so versatile is that it can operate effectively at relatively low DC voltages, i.e., on the order of 10 volts or less. In a specific embodiment, a volume mesh filter can be individually electrically powered by the use of a simple 9 volt battery. Because current drain in the filter is negligible, batteries can last for a very long time. Additionally, the low voltage operating capability imparts lightness in weight and great portability to filters of this design.

In another specific embodiment, the strand can be made of dual conductive insulated filaments, twisted together in a spiral configuration.

These and other advantages of the embodiments of the present invention can be seen in more detail and readily understood by reference to the following detailed description, and to the drawings, in which:

BRIEF DESCRIPTION OF THE DRAWINGS

FIG. 3 is a detailed pictorial view illustrating a portion of the vacuum cleaner of FIG. 1 incorporating another embodiment of the present invention;

FIG. 4 shows an embodiment alternative to that of FIG. 3;

FIG. 5 is a detail elevational view illustrating a portion of the structure shown in FIG. 2 and incorporating an alternate embodiment of the present invention;

FIG. 6 is an elevational detail view illustrating a portion of the structure shown in FIG. 2 and incorporating another alternate embodiment of the present invention;

FIG. 7 is a detail drawing of a portion of the structure shown in FIG. 2, showing another alternate embodiment of the invention;

BEST MODE FOR CARRYING OUT THE INVENTION

Figure 1:
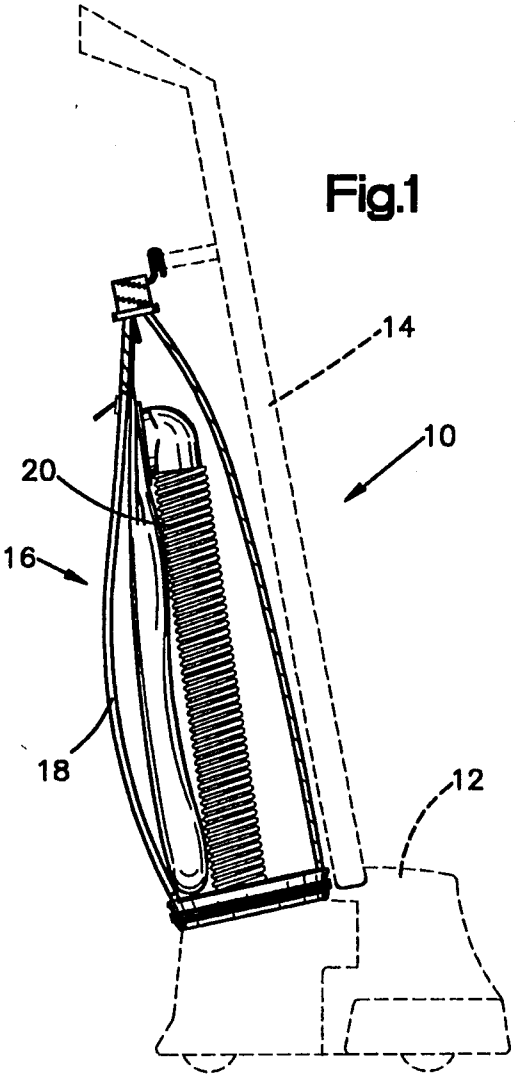
FIG. 1 is a pictorial side view partly broken away and partly in phantom, illustrating a vacuum cleaner incorporating an embodiment of the present invention.

FIG. 1 shows a vacuum cleaner 10 which incorporates the present inventive apparatus and circuitry for electrostatically filtering very fine particulate matter picked up by the vacuum cleaner. While the present invention is described in the environment of a vacuum cleaner, the invention is not limited to that particular application. Rather, the invention is believed applicable generally to electrostatic filtering in virtually any environment.

The vacuum cleaner 10 in which the present invention is incorporated is of otherwise known type. A vacuum cleaner suitably incorporating the present invention is a Kirby Model Generation 3, manufactured by Kirby Division, The Scott-Fetzer Company, Cleveland, Ohio, U.S.A. The vacuum cleaner includes a housing 12 and a handle 14 pivotally mounted to the housing (both in phantom). The housing 12 encloses a known electric motor and blower combination (not shown). The blower/motor combination, when actuated, generates a high velocity air stream for providing suction, and ducting (also not shown) for applying the generated suction to a region below the underside of the housing 12. The suction so generated dislodges dirt and other particulate matter from a surface on which the housing rests. The air stream generated by the blower/motor combination thus becomes laden with the particulate matter.

The ducting structure within the housing defines a discharge opening (not shown) near the rear of the housing 12. The particle-laden air stream is discharged from the discharge opening into a collection receptacle generally indicated by the reference character 16.

The collection receptacle 16 comprises a flexible bag having an opening which is removably attachable to position the opening to receive the particle-laden air flow discharge. The collection bag assembly 16 includes an air impervious outer jacket 18 made of finely woven or non-woven material. The collection bag assembly further includes an inner air impervious disposable paper filter paper bag. The outer jacket defines an exhaust opening in which the presently described electrostatic filter is placed.

The collection bag 16 of FIG. 1 is shown partially broken away to illustrate a multi-element structure, generally indicated by the reference character 20. This structure constitutes a portion of apparatus and circuitry comprising an electrostatic filtering unit according to the present invention.

Figure 2:
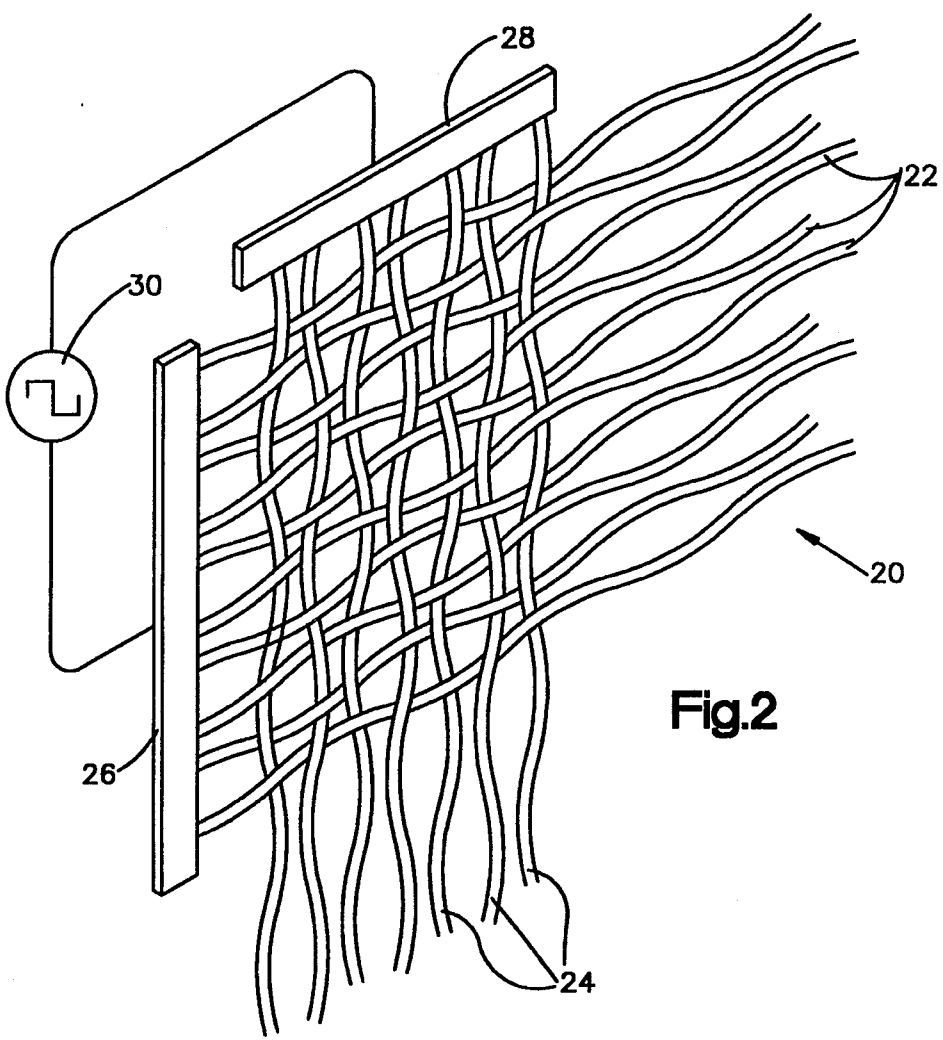
FIG. 2 is a pictorial detail view showing a portion of the vacuum cleaner of FIG. 1.

The structure 20 is illustrated in more detail in FIG. 2. The structure 20 comprises a fine electrically conductive wire mesh, or cloth.

The wire mesh 20 includes two sets of interlaced fine conductive filaments or wires. A first set of conductive wires extends generally horizontally as illustrated in FIG. 2. A second set of conductive wires extends generally vertically in FIG. 2. Representatives of the first set of wires are indicated collectively by reference character 22. Representatives of the second set of wires are denoted collectively by reference character 24.

Each of the individual wires of the sets 22, 24 are electrically insulated. Each of the wires making up the mesh comprises a copper wire approximately 0.002 inches in diameter and covered by a thin insulating material, in this case a coating of enamel.

Alternately, each of the wires of the mesh comprises an aluminum wire of approximately 0.002 inches in diameter. Where aluminum is used, aluminum oxide which naturally forms in the presence of air on the outside surface of the wires provides the needed insulation.

In place of metallic wires, the mesh 20 can optionally comprise filaments of known types of conductive plastic material.

Each of the first set of conductors 22 is conductively coupled at one end, by gold or nickel contacts, to a common busbar 26. Each of the second set of conductive wires 24 is conductively coupled at one end by similar contacts, to a busbar 28.

The first and second sets of conductors 22, 24 correspond, in Weaver's terminology, to the "warp" and "weft" of cloth.

A source 30 of alternating electrical voltage is coupled between the busbars 26, 28. The source 30 applies a square wave having peak voltage of approximately 9 volts positive and negative, to the busbar 28. The busbar 26 is substantially grounded.

The source 30 can be constructed from the combination of a 9 volt battery and a polarity reversing switch, circuitry well within the ordinary skill in the art, given the present disclosure.

The battery can be disposable. Alternately, the battery can be of the rechargeable variety. In such an instance, the recharging of the battery can be accomplished by known apparatus and circuitry coupled to draw power from the main power operating system of the vacuum cleaner.

Tests have shown that both lower and higher voltages can be effective. Voltages as low as one half volt can be useful in some systems. Voltages up to 200 volts are also feasible, where safe materials are provided.

The ends of the wires 22 comprising the first set opposite the busbar 26, terminate in electrical insulation, and are not conductively coupled together. The ends of the wires 24 of the second set opposite the busbar 28 also terminate in electrical insulation. This configuration renders the electrical source 30, combined with the wire sets 22, 24, a primarily capacitive open circuit, rather than a resistive circuit. The circuit is not conductively closed. As such, the current flow in the circuit, and the power consumed, is extremely small. Such low power requirements make it possible for the 9 volt battery to be very small and lightweight. This contributes to the portability, simplicity, and economy of the vacuum cleaner 10 with which the electrostatic filter is associated.

Tests have shown that a suitable frequency of electric polarity reversal, or alternation, for improving filtration effectiveness, is on the order of one cycle per second, or lower, down to about one cycle every 20 minutes. It is believed, however, that selection of the optimum frequency of operation depends on other parameters of the system, such as wire diameter and the size of the interstices of the mesh, along with air flow velocity, voltage, humidity, etc.

A low frequency of reversal, however, is of value in all instances. Low frequency allows time between reversals for the circuit to reach a steady state and for beneficial electrostatic phenomena, described in more detail below, to occur.

Other tests have shown that a mesh having approximately 200 wires per inch can accomplish effective electrostatic filtration. This amounts to a center to center spacing of the wires of approximately 0.003 inches.

For most of the time, (between reversals) a constant electrical potential difference of constant polarity is applied between the wire sets 22, 24.

When an electrical potential difference of constant polarity is provided between the wire sets, an electric field of constant polarity is generated in the interstices between wires of the different respective sets.

This electric field can be quite strong indeed.

With the mesh as above described, even a relatively low voltage, i.e., about 9 volts, can generate electric fields between respective sets of wires on the order of 5,000 to about 100,000 volts per meter.

These strong electric fields cause the wire sets to attract fine airborne particulate matter in the vicinity of the mesh. When a potential difference is applied between the wire sets, the surfaces of the wire insulation become electrically charged. When a positive voltage is applied to a wire, its insulation surface tends to become positively charged. When a negative voltage is applied, the insulation surface tends to become negatively charged.

These charges perform two beneficial functions. First, they attract all particulate matter (and naturally occurring atmospheric ions) having a net charge which is opposite to the charge appearing on the wire insulation surface. Additionally, they attract, by electrophoresis, even particles having a net neutral, or zero, electrical charge.

The mesh 20 is located within the collection bag 16, near the inner surface of the outer jacket portion 18. The mesh 20 is of sufficient lateral expanse to enable it to cover a substantial portion of the interior of the bag jacket. Thus, the mesh 20 intercepts the particle-laden air stream discharged into the bag. When the electrical source 30 is actuated, applying the electrical potential difference between the two sets of wires 22, 24, the electric fields so generated cause the mesh to attract and retain dirt, atmospheric ions and other very fine particles borne by the air stream passing through the mesh.

Filtered particles include allergy-causing pollen, which can be very small, and can even include bacteria, thus removing from the air a substantial amount of these health-hazardous organisms.

The alternation, or reversal, of the polarity of the voltage applied between the first and second sets of wires of the mesh 20 helps maintain filtration performance even as the mesh begins to "load up" with accumulated trapped particulate matter, and with atmospheric ions. If the polarity of the voltage were always constant, accumulated particles and ions on the wires would inhibit further attraction and retention of other particles.

When particulate matter and ions accumulate on the charged wire insulation surfaces, the accumulated material reduces the electric fields generated between the sets of wires in the mesh. The charge of the accumulated particles, and of attracted naturally occurring ions, tends to cancel the electric fields produced between the wires. This reduces filtration effectiveness.

An important aspect of solving this problem is the repeated reversal of the polarity of electrical voltage between the wire sets constituting the mesh. Advantages of this polarity reversing technique, as explained below, result in part from residual charge which remains on the wire outer insulation surface from the previous cycle of voltage polarity. These advantages include both restoration and strengthening of the filtering electric fields following polarity reversal.

For explanation, consider the situation where the voltage polarity is positive, such that a given wire insulation surfaces bears a positive surface charge. Particle and ionic charge facing the wire insulation will be negative. If the voltage polarity applied to the wire is now abruptly reversed (made negative), the amount of negative charge at and adjacent the wire insulation surface will substantially double. This occurs because the negative residual charge on the retained ions and particles, (left over from when the wire was positively charged) plus negative surface charge newly appearing on the wire insulation surface after the reversal, will jointly add to restore, and substantially double, the electric field.

Due to the somewhat insulative property of the adhering particles, the residual charge will decline only gradually, not all at one, after polarity reversal. Over time, however, the residual charge on the particles will decay. This is mainly due to oppositely charged particles and ions which are attracted to the wire insulation surface after its polarity goes negative. The charge reversal will cause some of the particles to move and adhere to the wires of the opposite set in the mesh.

FIG. 3 illustrates an embodiment of the present invention incorporating multiple, serially arranged conductive wire meshes 32, 34, 36. Each of the meshes, 32, 34, 36, is the same as the mesh 20 illustrated in FIG. 2 and described in connection with that Figure. An alternating voltage source 40 is connected in parallel to the respective wire sets of each of the meshes 32, 34, 36. The circuitry and apparatus constituting the source 40 are the same as in the voltage source 30 illustrated in FIG. 2.

The conductive wire meshes 32, 34, 36 are arranged serially with respect to air flow within the collection bag 16. For the purposes of FIG. 3, the direction of air flow is indicated by an arrow 42. The advantage of the multiple mesh embodiment of FIG. 3 is that the three meshes 32, 34, 36, acting serially in conjunction with one another, can normally be expected to attract and retain more of the fine particulate matter present in the air stream.

Optionally, a layer of fibrous mechanical filter material can be added between the mesh stages.

While FIG. 3 illustrates the alternating polarity voltage source 40 as a single source connected in parallel to each of the meshes 32, 34, 36, it is to be understood that the source 40, with its parallel connections to each of the meshes, could be replaced by an individual similar source each dedicated to a single one of the meshes 32, 34, 36. The use of individual sources for each of the meshes of FIG. 3 enables the polarity reversals on the three meshes to take place spaced in time from one another, rather than in unison, as in the FIG. 3 embodiment where the parallel coupled source 40 is used. Individual sources each coupled to a different mesh enable a sequential polarity reversal.

FIG. 4 illustrates another embodiment of the present invention employing multiple meshes in a staggered configuration. FIG. 4 illustrates two serially arranged meshes 44, 46. The mesh 44 is located upstream, relative to the air flow, with respect to the mesh 46. FIG. 4 illustrates the mesh 44 as diagonally staggered with respect to the mesh 46. The amount of this diagonal staggering is such that the intersections of wires, such as 48, in the mesh 44 are located approximately in the center of the interstices of the mesh 46. This staggering increases the density of charged wires disposed in the air stream, without substantially increasing resistance to the air stream.

Other means can be used to enhance operation of the mesh filters. Tests have shown that filtration performance can be improved by the addition of a high permitivity material in, or between, the woven meshes. A suitable material has been found to comprise aluminum oxide grit.

FIG. 5, for example, shows a pair of vertically extending wires 60, 62. FIG. 5 is a view looking at two meshes edgewise. FIG. 5 is simplified for purposes of clarity, with the wires 60, 62 being isolated single vertical wires of adjacent meshes.

Between the wires 60, 62 is a portion 64 of high permitivity material. The high permitivity material substantially fills the space between the adjacent meshes.

The high permitivity material 64 comprises particles of aluminum oxide of the order of microns in diameter, held together, if need be, by a suitable insulative binder which can be provided by one of ordinary skill in the art. The presence of this fine powder material between the meshes and in the vicinity of the conductive wires enhances the magnitude of the electric field which can be achieved between wires for a given voltage difference.

Optionally, the high permitivity material, such as aluminum oxide, can be supported on a nylon mesh substraight, or can be impregnated into fused pellets made of the material commonly known by the trademark "TEFLON".

FIG. 6 illustrates a similar pair of wires 68, 70, but in this embodiment the high permitivity material is present not only between the meshes, as at reference character 72, but also extends through the meshes to the exterior, such as shown at reference characters 74, 76.

FIG. 7 illustrates still another manner of employing the high permitivity material. FIG. 7 illustrates a single mesh 80. The high permitivity material is applied locally between each intersection of a horizontal and vertical wire, as shown for example at reference character 82.

Optionally, the electrostatic filtration unit 20 can be supplemented by inclusion in the vacuum cleaner of a corona discharge device in the dirty air stream. The corona discharge device imparts an electrical charge to dirt and other particulate matter passing through its corona. This additional charge renders the particles more susceptible of capture by the electrostatic filtration unit 20.

Another possible option is the use of a triboelectric device. Such a device, which can comprise tubes made of a plastic material known by the trademark TEFLON, can also impart an electrical charge to particles passing in the vicinity.

As mentioned above, the alternating voltage source, such as at reference character 30 in FIG. 2 and 40 in FIG. 3, can comprise a 9 volt small lightweight battery in series with a polarity reversing switch. It is believed that a suitable polarity reversing switch for placement in series with a low voltage battery can readily be designed by one of ordinary skill in the art.

Figures 8, 9:
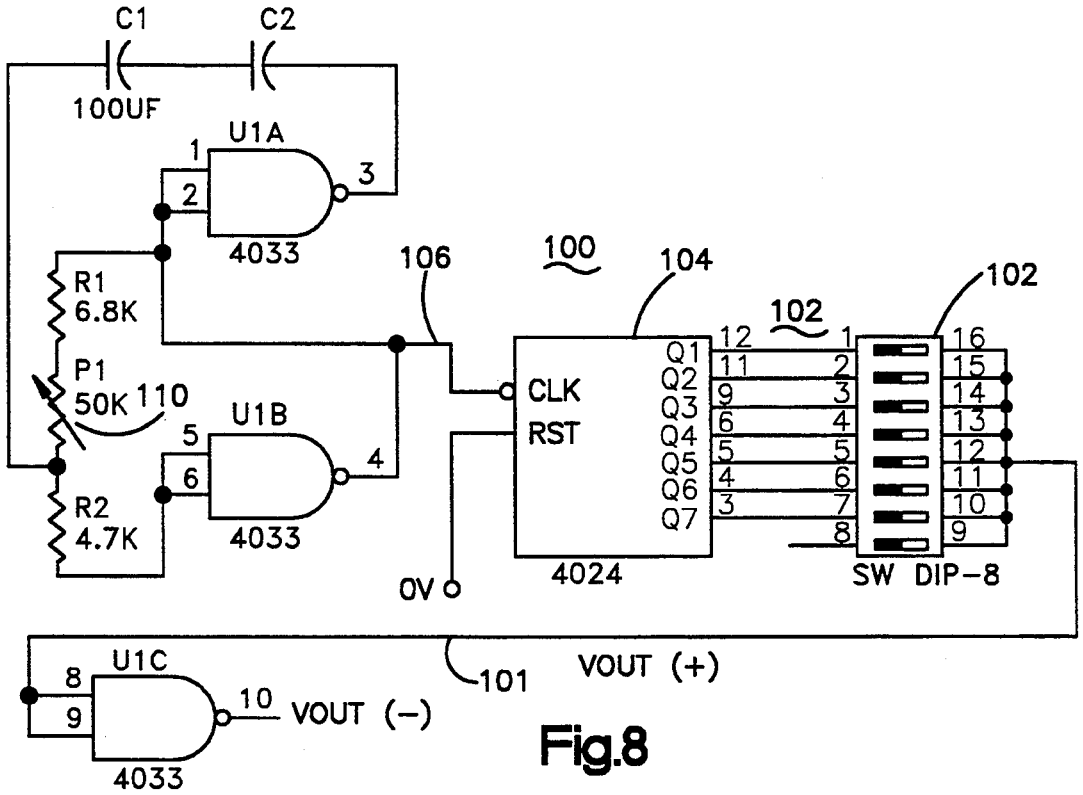
FIG. 8 is a schematic drawing of a circuit which constitutes a portion of an embodiment of the present invention.
FIG. 9 is a tabular rendition describing an aspect of the operation of the present invention.

FIG. 8 illustrates in schematic form a circuit for providing a low voltage alternating polarity signal suitable for use in the present device. The circuit is generally indicated by the reference character 100. The circuit produces a low voltage alternating polarity output at a lead 101. The output 101 is fed by the output of an 8 position dip switch 102. The inputs to the dip switch 102 are provided by a seven stage clocking circuit 104. In operation, only one of the switching elements of the dip switch 102 is set to provide a conductive path from one of the inputs of the dip switch to a corresponding one of its outputs. The dip switch is used to divide the output of the clocking circuit 104 according to the respective significant bits of the outputs of the clock. The output appearing at the lead 101 has a frequency of reversal which is a function of which one of the output bits of the clock is selected by the setting of the dip switch 102. The higher the significance of the clock bit output selected, the lower is the frequency of polarity reversal of that output.

The clocking signal is supplied to the clocking circuit 104 at a lead 106. The frequency of the clocking signal can be adjusted by adjusting the setting of a potentiometer 110. This operation is described in more detail in connection with FIG. 9.

FIG. 9 is a tabular rendition illustrating the functioning of the switching circuit 100. The upper table of FIG. 9 correlates the selected position of the dip switch 102 with the amount of time elapsing between successive reversals of polarity of the voltage applied to the meshes. As can be seen, the amount of time between successive polarity reversals can be selected to vary in increments between 1 second and 64 seconds. This corresponds to a frequency of alternation of between 30 cycles per minute and about ½ cycle per minute.

Further adjustment of switching frequency can be obtained by adjusting the potentiometer 110 in the switching circuit 100. The upper table of FIG. 9, described above, corresponds to the switching times which are available with the potentiometer turned to one extreme position. The table constituting the bottom portion of FIG. 9 gives the analogous switching times with the potentiometer in its opposite extreme position. As can be seen from the bottom table, with the potentiometer in its opposite position, switching times range between about 7 seconds and 448 seconds.

Accordingly, the switching frequency can be adjusted to a virtual infinity of values between one switching per second and one switching per 448 seconds.

Figure 10:
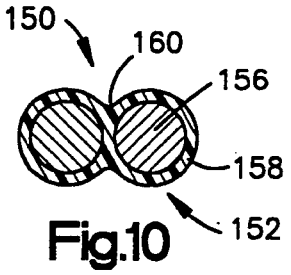
FIG. 10 is a cross-sectional drawing illustrating a component of an alternative embodiment of an electrostatic filter according to the present invention.
Figure 11:
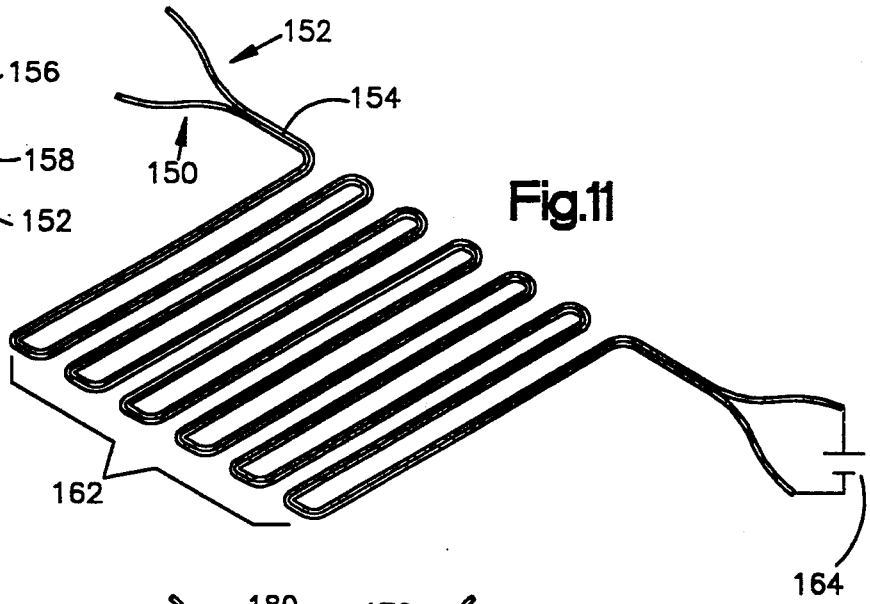
FIGS. 11–15 illustrate the components of FIG. 10 in a variety of alternative configurations of electrostatic filters.

FIG. 10 illustrates in cross section an alternative embodiment of the electrostatic filter medium of the present invention. The alternative embodiment illustrates a pair of insulated conductive filaments 150, 152 which are shown in cross section in FIG. 10. The filaments 150, 152 are insulated, and are disposed in a generally parallel, side-by-side relationship. In this configuration, the filaments 150, 152 together constitute a dual filament strand, such as illustrated at 154 in FIG. 11. The insulated filaments 150, 152 are substantially touching over a significant portion of their respective lengths. In FIG. 11, the filaments 150, 152 are shown as being in a substantially touching relationship over most of their respective lengths, such as indicated at 154. In FIG. 11, however, the ends of the filaments 150, 152 are separated somewhat, to facilitate their being connected to a source of electrical potential difference, to apply an electrical potential difference between the filaments 150, 152.

Each of the filaments 150, 152 includes a central portion such as 156 made of conductive material, such as copper, and a thin coating of insulation indicated, for example, at 158 in FIG. 10. Note that the diameter of the conductive portion 156 is large relative to the thickness of the insulation layer 158. Preferably, the insulation layer 158 can comprise a coating of enamel.

The filaments 150, 152 are adhered together at a region generally indicated at 160 in FIG. 10. The adhesion can take place by means of a known form of adhesive applied between the filaments. Alternately, the adhesion can take place by virtue of adhesive properties of the insulating material 158 itself.

In practice, the length of the dual strand comprising the insulated, closely spaced filaments 150, 152 is at least many yards.

Preferably, the diameter of the conductive portion, such as 156, and the thickness of the insulating layer illustrated, for example, at 158 are similar to those described in connection with the previously discussed mesh embodiments.

It should be understood that each of the two conductive filament portions of the dual filament strand is connected to a different respective terminal of a source of electrostatic potential difference, in the neighborhood of 9 volts, in order to apply an electrical potential difference between the conductive filaments, and to establish a strong electric field between the two filaments making up the strand. It should be assumed that the source of electrical potential difference should be similar to those electrical potential difference sources which are described in connection with the previously described embodiments. Additionally, it is preferable to include switching means for reversing at low frequency the polarity of the electric potential difference between the conductive filaments, for the reasons discussed in connection with the previous embodiments.

FIGS. 11–15 illustrate various configurations of the dual filament strand illustrated in cross section in FIG. 10, in order to dispose the strand in a variety of filtering configurations.

For example, FIG. 11 shows the strand arranged in a serpentine, back and forth winding configuration, generally in a plane, in order to provide an electrostatic filter for gas passing through the serpentine configuration of dual filament strand in order to capture on the strand minute particles in the gas flow, which flow is occurring substantially perpendicular to the plane in which the strand is disposed in its serpentine configuration.

It should be understood, in connection with the embodiments of FIGS. 10–16, that the two filaments making up the dual wire strand are coupled to the voltage source such that electrical current flow between the conductive filaments is negligible. That is, the only point at which the dual filaments are coupled together conductively is at the voltage source such as illustrated at 164 of FIG. 11. The opposite ends of the dual wire strand, indicated by 150, 152 in FIG. 11, are not conductively coupled together, but rather terminate in electrical insulation, such that there is no conductive electric current flow between the conductive filaments or wires making up the dual strand arrangement.

Figure 12:
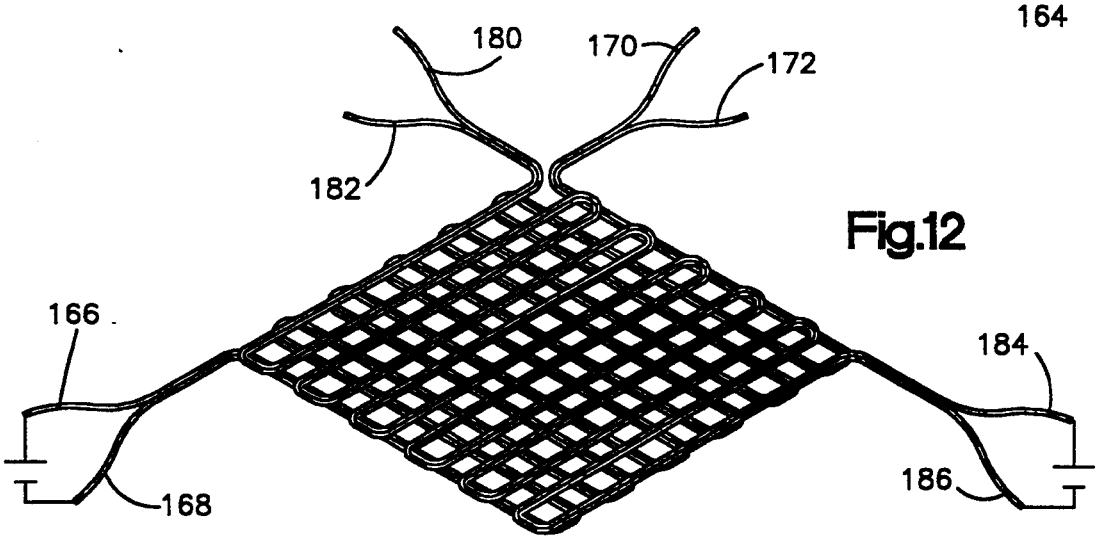

FIG. 12 illustrates another arrangement of the dual strand.

FIG. 12 illustrates the use of two dual wire strands arranged together to form a generally rectilinear grid pattern. One strand consists of filaments whose ends are indicated respectively by 166, 168, which correspond to ends 170, 172, respectively. The other strand consists of filaments whose ends are indicated respectively by 180, 182, which correspond to ends 184, 186.

It should be understood that the rectilinear pattern illustrated in FIG. 12 can also be made of a single, dual wire strand, rather than using two strands. The strand is criss-crossed over itself. It can also be disposed in several layers.

Figure 13:
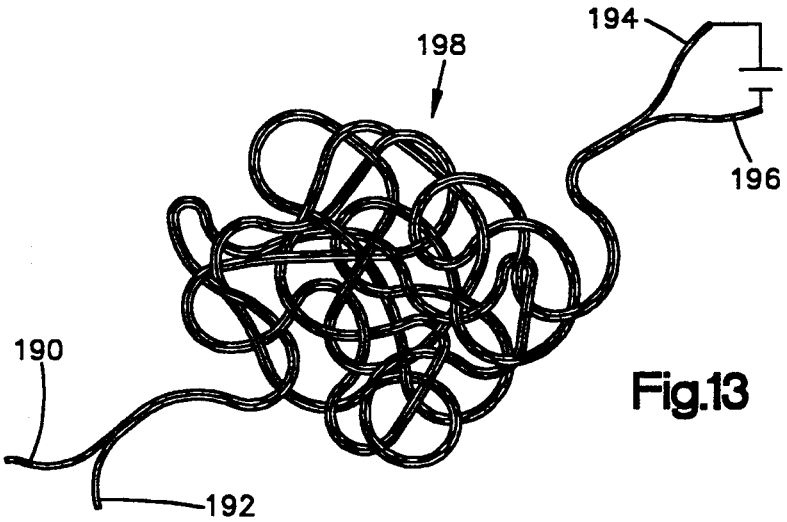

FIG. 13 illustrates a "random mesh" or "volume mesh" configuration of a single dual wire strand, having ends 190, 192, which correspond to ends 194, 196. In the embodiment of FIG. 13, a long length of the dual wire strand is simply compressed together in a random fashion, which forms a number of tortuous paths for gas which is conveyed through the random mesh portion indicated generally at 198. The random mesh strand crosses itself at many locations and in many layers.

Figure 14:
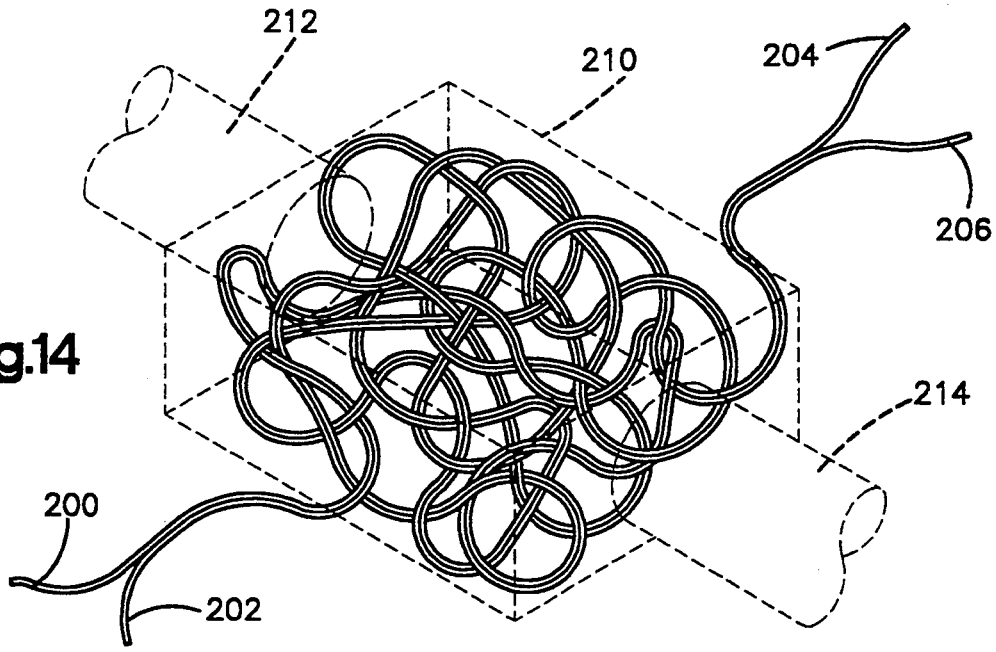

FIG. 14 illustrates a variant of the random mesh configuration, in which a random mesh is formed of a single dual wire strand whose ends are indicated at 200, 202, which correspond to the ends indicated at 204, 206. The randomly compressed portion of dual strand is, in the FIG. 14 embodiment, confined within a containing structure indicated in phantom in FIG. 14 and generally designated by character 210. Gas to be filtered enters the confining structure 210 through an intake, also indicated in phantom at 212, and exits from the confining structure 210 via an outlet also indicating in phantom and designated by 214.

Figure 15:
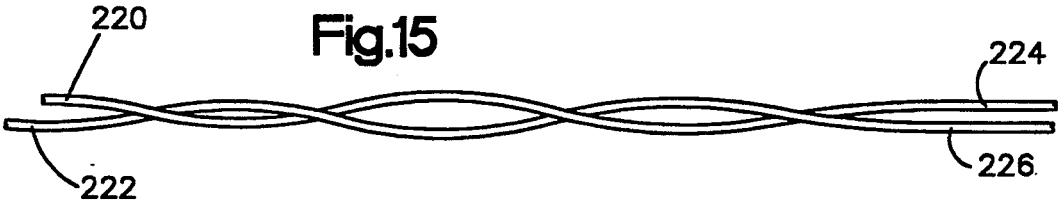

FIG. 15 illustrates still another possible arrangement of the dual filament strand. In the FIG. 15 embodiment, the dual filaments are illustrated as being twisted together. The dual filaments are indicated in FIG. 15 by ends 220, 222, which correspond to opposite ends 224, 226, respectively. It should be understood that a twisted filament configuration such as shown in FIG. 15 can itself be arranged in a serpentine configuration, such as shown in FIG. 11, a rectilinear configuration such as shown in FIG. 12, or a random mesh configuration as illustrated in FIGS. 13 and 14.

Figure 16:
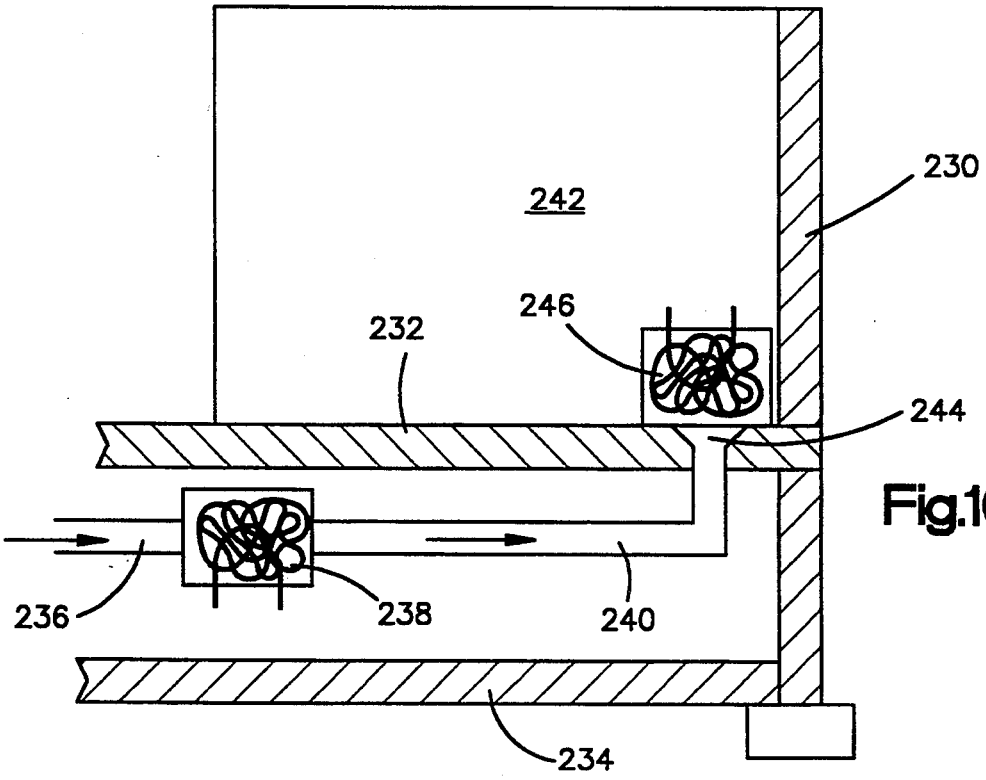
FIG. 16 is a cross-sectional view showing the filter in an HVAC system.

FIG. 16 illustrates a random mesh filter disposed in an HVAC system.

FIG. 16 illustrates a cross section of a portion of a building, showing a wall 230, a floor 232, and a foundation generally indicated at 234.

An input duct 236 delivers air to a random mesh filter 238 which is constructed similarly to the confined random mesh embodiment illustrated in FIG. 14. Air exits the random mesh confined filter 238 by way of ducting 240, through which it enters a room, generally designated at 242, by way of a room register 244.

The register 244 can additionally be covered by another confined random mesh filter 246, positioned over the register itself to additionally filter the air. Alternately, the confined random mesh filter 246 can be used without the confined random mesh filter 238.

An advantage of the present random mesh filter is that, because of its very low voltage requirement, it can be portable. A random mesh filter such as at 246 can be simply moved by hand and put in place over an air delivery register in a room. Its low voltage requirement means that the necessary voltage for charging the filter electrostatically can be provided by a small battery, which is also quite portable, and the filter unit need not be connected to a permanent source of through power. Filters can easily be changed, or moved from one air register to another. The small battery used to power the filter is very long lived, in view of the fact that there is negligible electric current flow in the filter itself.

While the present invention has been described in particularity, it is to be understood that those of ordinary skill in the art may make certain additions or modifications to, or deletions from, the specific features of the embodiments described herein, without departing from the spirit or the scope of the invention, as described in the appended claims.

I claim:

1. An electrostatic volume filter comprising:

a) a strand of two closely spaced, thin, elongated electrically conductive filaments, each bearing about its circumference solid, flexible non-porous electrical insulation and maintained with the electrical insulation of one filament next to the electrical insulation of the other filament at locations along the filament lengths, said strand being criss-crossed along its length in several layers to form a gas permeable filter body, and b) circuitry for applying an electrical potential difference between said filaments.

2. The filter of claim 1, further comprising:

means for holding said two filaments together in a substantially parallel side-by-side relationship to form a dual filament strand.

3. The filter of claim 1, wherein:

said strand is criss-crossed in random fashion to form tortuous gas permeable paths.

4. The filter of claim 1, wherein:

said circuitry comprises means for reversing the polarity of the electrical potential difference applied between said filaments.

5. The filter of claim 4, wherein said reversing means further comprises:

means for reversing said polarity not more than about once per second.

6. The filter of claim 1, wherein:

at least one of said filaments comprises a fine copper wire.

7. The filter of claim 6, wherein:

said electrical insulation comprises a coating of enamel on said copper wire.

8. The filter of claim 6, wherein:

said copper wire has a diameter of approximately 0.004 inches.

9. In a vacuum cleaner having (1) a suction air stream producing apparatus for dislodging and picking up particulate matter into said air stream, and for discharging said air stream, laden with said particulate matter, and (2) a particulate matter collector positionable to receive the discharge of said particulate laden air stream, an electrostatic filter comprising:

a) a strand of two electrical insulation-bearing electrically conductive filaments, the electrical insulation comprising solid non-porous material, said insulation of one of said filaments substantially touching the electrical insulation of the other filament at several points along said two filaments, said strand being randomly criss-crossed in several layers along its length to form a gas permeable filter body, and b) circuitry coupled to said two filaments for applying an electrical potential therebetween.

10. The filter of claim 9, wherein:

said circuitry comprises electrical circuitry for reversing the polarity of said applied electrical potential.

11. The filter of claim 9, wherein:

said filaments comprise fine copper wires, and said electrical insulation comprises a coating of enamel applied to said copper wires.

12. The filter of claim 9, wherein:

said polarity reversing circuitry comprises circuitry for reversing said polarity at a frequency of no more than about once per second.

13. The filter of claim 9, further comprising:

means for affixing said two filaments together for maintaining said filaments in a substantially parallel closely spaced side-by-side relationship.

14. A filtering member comprising:

a) a strand of electrically conductive filaments electrically insulated from one another, said filaments being, along a substantial portion of the length of said strand, separated from one another by a distance of less than about the diameter of one of said filaments and arranged in a winding configuration;

b) said strand being criss-crossed in several layers along its length to form a gas permeable filter body;

c) circuitry for applying an electrical potential difference between said filaments to create an electric field along the length of said strand sufficiently strong to attract dust particles for capture on said filaments, and d) circuitry for reversing the polarity of said applied potential difference.

15. An electrostatic filter comprising:

a) a dual conductor assembly including two thin conductive filaments separated by solid, non-porous electrically insulating material and said filaments being closely spaced along a substantial portion of the length of each conductor, said dual conductor assembly being positioned over its closely spaced portion to form a criss-cross mesh extending over a substantial area, and b) circuitry for applying an electrical potential difference between said filaments.

16. A volume mesh electrostatic filter comprising:

a) a volume mesh having two closely spaced electrically conductive elongated filaments, along a substantial portion of filament length, each filament bearing a thin layer of solid non-porous insulating material, and being separated by said solid non-porous electrically insulating material, said insulating material layer being substantially uniform in thickness about the circumference of each filament, said closely spaced portion of said filaments being packed within a predetermined volume and arranged within said volume in random criss-crossed fashion to define tortuous gas permeable paths, and b) circuitry for applying an electrical potential difference between said filaments.

17. A vacuum cleaner comprising:

a) apparatus and structure for producing a suction air stream for dislodging and carrying particulate matter from a surface to be cleaned and for delivering said air stream carrying said particulate matter to a discharge location;

b) a collection bag positionable near said discharge location to accept a discharge of said air stream carrying said particulate matter, said collection bag comprising:

i) an outer cover defining an exhaust opening;

ii) an electrostatic volume mesh filter positioned in said exhaust opening, said filter being formed by a strand of two insulated conductive filaments closely spaced along a substantial portion of the length of said filaments, each filament bearing a layer of insulation having approximately uniform thickness about the circumference of the filament, said strand being randomly criss-crossed in several layers along its length to form a filter body having tortuous air passages therethrough, and iii) circuitry for applying an electrical potential difference between said filaments and for reversing the polarity of said applied electrical potential difference not more than about once per second.

18. A filter comprising:

a) electrically conductive filaments, said filaments being electrically insulated from one another by solid, flexible, non-porous electrically insulating material;

b) circuitry for applying an electrical potential difference between said filaments to create an electrical field sufficiently strong to attract dust particles for capture on said filaments;

c) said filaments being arranged to form a mesh wherein an insulated filament of one electrical potential substantially touches an insulated filament of another electrical potential, and d) means for reversing the polarity of said applied electrical potential difference.

19. A filter comprising:

a) two thin filaments, each filament having a conductive core surrounded by thin, solid, non-porous insulating material;

b) circuitry for applying an electrical potential difference between the respective conductive cores of said filaments to create an electrical field sufficiently strong to attract dust particles for capture on said filaments;

c) said filaments being arranged to form a mesh wherein a filament whose core is at one electrical potential substantially touches a filament whose core is at another electrical potential, and d) circuitry for reversing the polarity of said applied electrical potential difference.

20. A filter comprising:

a) a pair of filaments, each filament having a conductive core covered by a thin layer of flexible, non-porous solid electrically insulating material, said filaments being held together in a side by side substantially parallel relationship with the respective electrically insulative layers of the two filaments substantially touching over a portion of their respective lengths;

b) circuitry for applying an electrical potential difference between the conductive cores of said filaments to create an electrical field sufficiently strong to attract dust particles for capture on said filaments;

c) said pair of filaments being arranged in a winding configuration, and d) circuitry for reversing the polarity of said applied electrical potential difference.

21. A filter comprising:

a) two filaments, each filament having a conductive central core covered with solid, non-porous electrically insulating material, said filaments being held together along a portion of their respective lengths in a substantially adjacent parallel touching relationship;

b) circuitry for applying an electrical potential difference between the conductive cores of the two filaments to create an electrical field sufficiently strong to attract dust particles for capture on said filaments;

c) said filaments being arranged in a winding configuration, and d) circuitry for reversing the polarity of said applied electrical potential difference.

22. The filter of claim 21, wherein:

said insulating material of each filament is substantially uniform in thickness around its conductive core.

23. The filter of claims 21, wherein:

the thickness of said insulation about the core of each filament is not appreciably greater than the diameter of said core.

24. A filter member comprising:

a) a strand of electrically conductive filaments electrically insulated from one another by insulation borne about the circumference of each filament, said insulation being relatively thin and comprising a solid material, said filaments being, along a substantial portion of the length of said strand, separated from one another by a distance of less than about the diameter of one of said filaments and arranged in a winding configuration;

b) said strand being criss-crossed in several layers along its length to form a gas permeable filter body;

c) circuitry for applying an electrical potential difference between said filaments to create an electric field along the length of said strand sufficiently strong to attract dust particles for capture on said filaments, and d) circuitry for reversing the polarity of said applied potential difference.

25. A filter comprising:

a) two thin filaments, each filament having a conductive core surrounded by a layer of solid electrically insulating material of a substantially uniform thickness about the circumference of each filament;

b) circuitry for applying an electrical potential difference between the respective conductive cores of said filaments to create an electrical field sufficiently strong to attract dust particles for capture on said filaments;

c) said filaments being arranged to form a mesh wherein a filament whose core is at one electrical potential substantially touches a filament whose core is at another electrical potential, and d) circuitry for reversing the polarity of said applied electrical potential difference.

26. A filter comprising:

a) thin electrically conductive filaments, each filament bearing a thin layer of solid electrically insulative material having a substantially uniform thickness about the entire circumference of the filament, each said filament thereby being easily bendable, and bendable with substantially equal ease about all axes perpendicular to the filament;

b) circuitry for applying an electrical potential difference between said filaments to create an electric field sufficiently strong to attract dust particles for capture on said filaments;

c) said filaments being in a side-by-side relationship with respective layers of insulative material touching over a substantial length of said filaments, said filaments being arranged to form a mesh wherein an insulated filament of one electrical potential substantially touches an insulated filament of another electrical potential; and d) circuitry for reversing the polarity of said applied electrical potential difference not more than about once per second.

* * * * *

UNITED STATES PATENT AND TRADEMARK OFFICE

CERTIFICATE OF CORRECTION

PATENT NO. : 5,376,168
DATED : December 27, 1994
INVENTOR(S) : Ion I. Inculet

It is certified that error appears in the above-indentified patent and that said Letters Patent is hereby corrected as shown below:

Title page, item [73] Assignee: L.D. Kichler Co. should read -- The Scott Fetzer Company, Westlake, Ohio--.

Signed and Sealed this

Twentieth Day of June, 1995

*Attest:*

Bruce Lehman

BRUCE LEHMAN

*Attesting Officer*

*Commissioner of Patents and Trademarks*